US009175680B2

(12) United States Patent
Miyaki et al.

(10) Patent No.: US 9,175,680 B2
(45) Date of Patent: Nov. 3, 2015

(54) ELECTRIC OIL PUMP SYSTEM

(71) Applicant: JTEKT CORPORATION, Osaka-shi, Osaka (JP)

(72) Inventors: Junichi Miyaki, Anjo (JP); Katsutoshi Nisizaki, Higashiosaka (JP); Yoshihiro Oono, Katsuragi (JP); Naotake Kanda, Yamatokoriyama (JP)

(73) Assignee: JTEKT CORPORATION, Osaka-shi (JP)

( * ) Notice: Subject to any disclaimer, the term of this patent is extended or adjusted under 35 U.S.C. 154(b) by 166 days.

(21) Appl. No.: 13/751,374

(22) Filed: Jan. 28, 2013

(65) Prior Publication Data

US 2013/0202464 A1 Aug. 8, 2013

(30) Foreign Application Priority Data

Feb. 2, 2012 (JP) ..... 2012-020722

(51) Int. Cl.

| | |
|---|---|
| ***F04C 11/00*** | (2006.01) |
| ***F01C 21/10*** | (2006.01) |
| ***F04C 15/00*** | (2006.01) |
| *F04C 2/10* | (2006.01) |

(52) U.S. Cl.

CPC ..... *F04C 11/008* (2013.01); *F01C 21/10* (2013.01); *F04C 15/008* (2013.01); *F04C 2/102* (2013.01); *F04C 2240/40* (2013.01); *F04C 2240/805* (2013.01)

(58) Field of Classification Search

CPC .. F04C 11/008; F04C 15/008; F04C 2240/40; F04C 2240/805; F04C 2/102; F01C 21/10

USPC ..... 417/410.3, 423.7, 423.14, 360, 363; 418/19, 61.3, 166, 171

See application file for complete search history.

(56) References Cited

U.S. PATENT DOCUMENTS

| | | | | |
|---|---|---|---|---|
| 3,514,649 | A * | 5/1970 | Nomura | 310/68 E |
| 3,680,987 | A * | 8/1972 | Ohrberg | 418/61.3 |
| 5,593,287 | A | 1/1997 | Sadakata et al. | |
| 6,663,362 | B1 * | 12/2003 | Lentz et al. | 417/423.7 |
| 7,872,392 | B2 * | 1/2011 | Haldemann et al. | 310/216.045 |
| 7,950,907 | B2 * | 5/2011 | Nagata et al. | 417/423.14 |
| 8,002,522 | B2 * | 8/2011 | Ihle et al. | 415/200 |
| 2005/0074343 | A1 * | 4/2005 | Naito | 417/423.3 |
| 2006/0250034 | A1 * | 11/2006 | Umezu | 310/67 R |
| 2008/0061645 | A1 | 3/2008 | Yukitake | |

(Continued)

FOREIGN PATENT DOCUMENTS

| | | |
|---|---|---|
| DE | 4440238 A1 | 5/1995 |
| JP | A-2005-098268 | 4/2005 |

(Continued)

OTHER PUBLICATIONS

Apr. 10, 2015 Extended European Search Report issued in European Patent Application No. 13153086.7.

*Primary Examiner* — Justin Jonaitis
*Assistant Examiner* — Stephen Mick
(74) *Attorney, Agent, or Firm* — Oliff PLC

(57) ABSTRACT

A stator is fixedly fastened at its outer periphery by a cylindrical and thin metal collar. One end of the collar is engaged with a pump housing. Multiple metal nuts are embedded in insulators fitted to stator cores through insert molding. The stator of a brushless motor is fixed by screwing bolts passed through the pump housing from a pump plate, to nuts embedded in the insulators.

6 Claims, 2 Drawing Sheets

(56) References Cited

U.S. PATENT DOCUMENTS

| | | | | |
|---|---|---|---|---|
| 2011/0135516 | A1* | 6/2011 | Oishi et al. | 417/410.4 |
| 2012/0128513 | A1 | 5/2012 | Sakata et al. | |

FOREIGN PATENT DOCUMENTS

| | | | |
|---|---|---|---|
| JP | 2005337025 | A | 12/2005 |
| WO | 2011016467 | A1 | 2/2011 |

* cited by examiner

ELECTRIC OIL PUMP SYSTEM

INCORPORATION BY REFERENCE/RELATED APPLICATION

The application claims priority to Japanese Patent Application No. 2012-020722 filed on Feb. 2, 2012 the disclosure of which, including the specification, drawings and abstract, is incorporated herein by reference in its entirety.

BACKGROUND OF THE INVENTION

1. Field of the Invention

The invention relates to an electric oil pump system.

2. Description of Related Art

There has been proposed an electric oil pump system that is a combination of an oil pump that circulates fluid (oil) and an electric motor that drives the oil pump. The electric motor includes a rotor that rotates and a stator that is fixedly arranged radially outward of the outer peripheral face of the rotor. The rotor is formed by arranging a plurality of permanent magnets on the outer peripheral face of a rotary drive shaft along its circumferential direction. The rotary drive shaft is a rotary shaft that is shared by the electric motor and the oil pump. In addition, there has been proposed an electric oil pump system in which a stator of an electric motor is fixed by screwing bolts passed through a housing of an oil pump, to a motor housing (refer to, for example, Japanese Patent Application Publication No. 2005-98268). Further, the stator of the electric motor is integrated, through resin molding, with insulators on which coils are wound.

However, if the oil pump and the electric motor are fastened to each other via a resin mold portion with bolts, the resin mold portion of the stator is brought into contact with a metal face of the housing of the oil pump. This contact portion may be creep-deformed due to age deterioration. Thus, for example, warpage of the stator and loosening of bolts may occur. As a result, a rotary shaft of the electric motor may cause rotation fluctuation. Further, there may be caused contact noise between internal teeth and external teeth in a rotor portion of the oil pump, operating noise of the electric oil pump system due to pulsation of pump discharge pressure, and reduction in pump output (pressure, flow rate).

SUMMARY OF THE INVENTION

The invention provides an electric oil pump system in which creep deformation of a resin mold portion of a stator of a motor is prevented and pump discharge pressure is stabilized.

According to a feature of an example of the invention, in an electric oil pump system including an oil pump, and an electric motor that is arranged next to the oil pump in an axial direction and that rotates the oil pump, a housing of the oil pump and a motor housing being fastened together via a stator of the electric motor, there is provided a cylindrical fixing member that is formed of a metal member and that fixes stator cores of the stator arranged radially inward of the cylindrical fixing member, and the fixing member is engaged with the housing of the oil pump and fixes the stator.

BRIEF DESCRIPTION OF THE DRAWINGS

The foregoing and further objects, features and advantages of the invention will become apparent from the following description of example embodiments with reference to the accompanying drawings, wherein like numerals are used to represent like elements, and wherein.

DETAILED DESCRIPTION OF EMBODIMENTS

Hereinafter, embodiments of the invention will be described with reference to the accompanying drawings.

Figure 1:
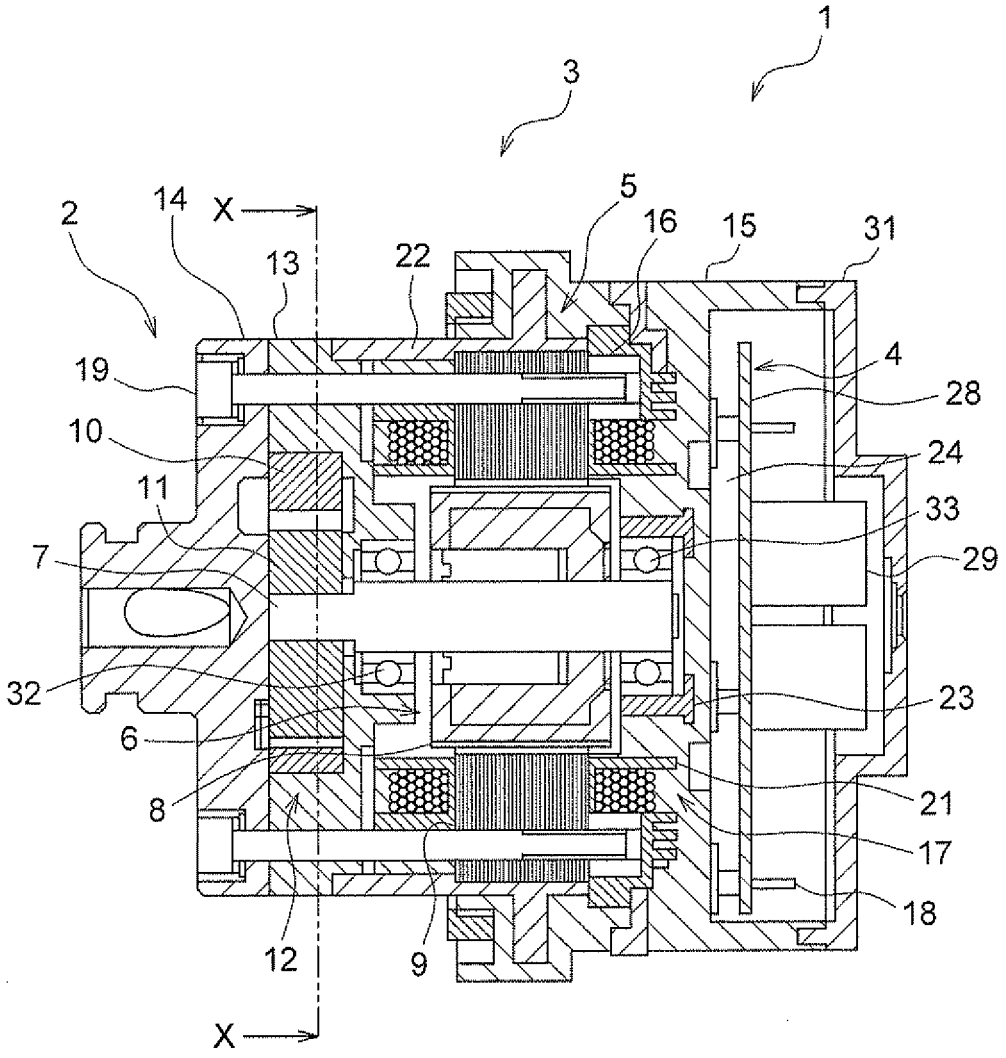
FIG. 1 is a partial sectional view illustrating the schematic configuration of an electric oil pump system, in an axial section, according to an embodiment of the invention.
Figure 2:
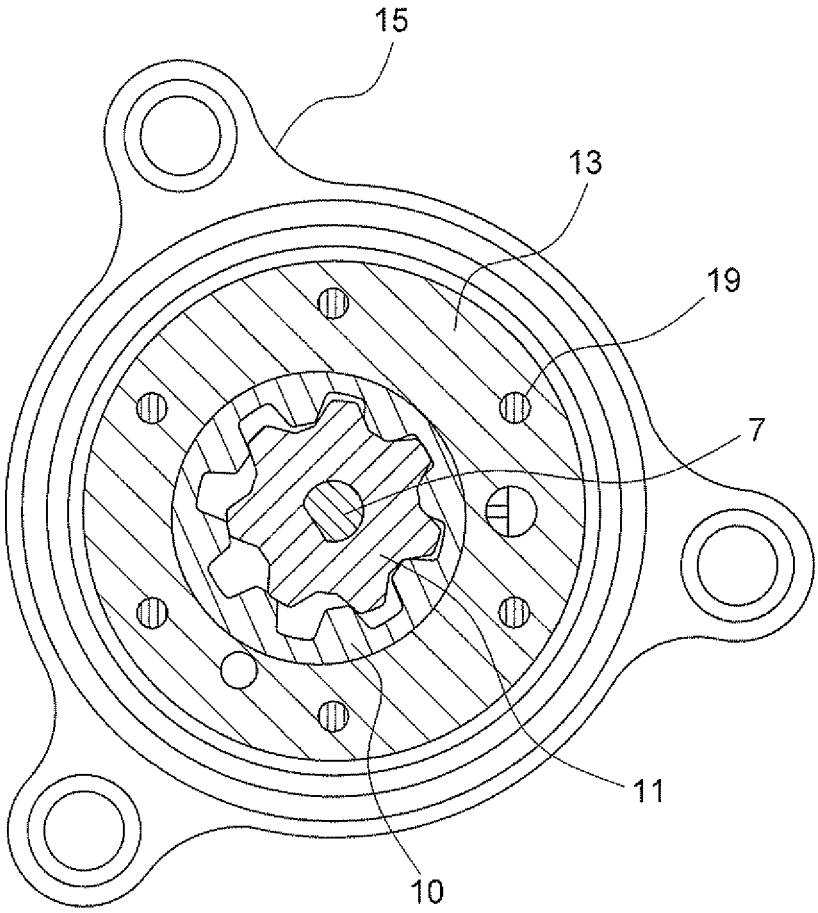
FIG. 2 is a sectional view illustrating a rotor portion of an oil pump (internal gear pump), taken along the line X-X in FIG. 1.

FIG. 1 is an axial sectional view illustrating the schematic configuration of an electric oil pump system according to an embodiment of the invention. FIG. 2 is a sectional view illustrating a rotor portion of an oil pump, taken along the line X-X in FIG. 1. As shown in FIG. 1 and FIG. 2, an electric oil pump system 1 is used as a hydraulic pump for a transmission of an automobile, and includes an oil pump (e.g. an internal gear pump) 2, and an electric motor (hereinafter, referred to as "brushless motor") 3 that rotates the oil pump 2. The electric motor 3 and the oil pump 2 are arranged next to each other and assembled together. Further, a controller 4 is also incorporated in a motor housing 15. The brushless motor 3 shown in FIG. 1 is a sensorless brushless motor.

In the oil pump 2, a pump inner rotor (hereinafter, referred to as "inner rotor") 11 with external teeth is arranged radially inward of a pump outer rotor (hereinafter, referred to as "outer rotor") 10 with internal teeth having a trochoid tooth profile, and the external teeth of the inner rotor 11 are meshed with the internal teeth of the outer rotor 10. In a pump housing 13, there is formed a pump portion 12 in which the outer rotor 10 and the inner rotor 11 are rotatably and eccentrically arranged.

The inner rotor is fixed to one end (left end in FIG. 1) of the outer periphery of a rotary drive shaft 7, and rotates together with the rotary drive shaft 7. The number of the internal teeth of the outer rotor 10 is greater by one than the number of the external teeth of the inner rotor 11. The outer rotor 10 is arranged in the pump housing 13 so as to be rotatable about a position that is offset from the rotational axis of the rotary drive shaft 7. Further, the inner rotor 11 rotates while some of the external teeth thereof are meshed with some of the internal teeth of the outer rotor 10 within part of the entire circumference, and the external teeth thereof are substantially in contact with the inner face of the outer rotor 10 at points on the entire circumference.

Therefore, when the rotary drive shaft 7 is rotated by the brushless motor 3, the volumes of the clearances between the outer rotor 10 and the inner rotor 11 in the oil pump 2 are repeatedly increased and decreased during one rotation of the rotary drive shaft 7. Thus, the pumping action is carried out, that is, oil is delivered from an inlet (not shown) to an outlet (not shown). The inlet and the outlet are formed in a pump plate 14 and communicated with the clearances.

The brushless motor 3 includes a motor rotor (hereinafter, referred to as "rotor") 6 that rotates, and a motor stator (hereinafter, referred to as "stator") 5 that is fixedly arranged radially outward of the outer peripheral face of the rotor 6. The rotor 6 is formed by arranging, for example, a plurality of permanent magnets 8 on the outer peripheral face of the rotary drive shaft 7 along its circumferential direction. The rotary drive shaft 7 is a rotary shaft that is shared by the brushless motor 3 and the oil pump 2. Respective end portions of the rotary drive shaft 7 are rotatably supported by bearings 32, 33 that are arranged radially inward of the pump housing 13 and a rotor support member 23, respectively.

The stator 5 has a plurality of teeth (not shown) that extend radially inward from split stator cores 9, and that are located radially outward of the outer peripheral face of the rotor 6 with a slight air gap left between the teeth and the rotor 6. Insulators 21, which are made of resin (e.g. PPS) and used to insulate a coil 17 from the stator core 9, are fitted to each of the teeth of the stator cores 9 from respective sides in the axial direction. The coil 17 (one of a U-phase coil 17, a V-phase coil 17 and a W-phase coil 17) is wound around each of the teeth. In this way, a stator subassembly is formed. The stator 5 is formed of a plurality of the stator subassemblies. The stator subassemblies are fixedly fastened at their outer peripheries by a cylindrical and thin collar (fixing member) 22 made of metal (i.e. iron).

Each coil 17 is electrically connected at an end to a bus bar 18. The insulators 21 are molded integrally with three bus bars 18 that serve as driving terminals of the brushless motor 3. The bus bars 18 extend from the right end portion of the insulators 21 in parallel with the center axis.

The stator 5, the rotor support member 23 and the bus bars 18 are molded integrally with the motor housing 15. Sealing members provide sealing between the motor housing 15 and the bus bars 18.

Further, multiple (e.g. six) nuts 16, which are made of metal (e.g. iron or copper), are placed in the insulators 21 fitted to the stator cores 9 so as to be arranged around the rotational axis along the circumferential direction, and embedded in the insulators 21 through insert molding. Then, the stator 5 of the brushless motor 3 is fixed by screwing bolts 19, which are passed through the pump housing 13 from the pump plate 14, to the nuts 16 embedded in the insulators 21.

The pump plate 14 and the pump housing 13 that constitute the housing of the oil pump 2 are made of non-magnetic material (e.g. aluminum die casting). The motor housing 15 and a cover 31 that accommodate the brushless motor 3 and the controller 4 are made of resin material (e.g. thermoplastic resin). The housing body of the electric oil pump system 1 is formed of the pump plate 14, the pump housing 13, the collar 22, the motor housing 15 and the cover 13. The motor housing 15 and the cover 31 constitute a waterproof cover.

Further, in the electric oil pump system 1 according to the present embodiment, a control circuit board (hereinafter, referred to as "circuit board") 28 of the controller 4 that controls the brushless motor 3 is accommodated in a control chamber 24 which is defined in the motor housing 15, at a position on the opposite side from the motor. The control circuit board 28 is attached to an end face of the motor housing 15 with screws. A control circuit portion 29 is mounted on the control circuit board 28. The control circuit portion 29 is formed of an inverter circuit that converts DC power into AC power and supplies drive current to the coils 17 of the brushless motor 3, and a control circuit that controls the inverter circuit on the basis of information on the rotational position of the outer rotor 10, which is detected by a sensor such as a Hall element. Microcomputers and electronic components such as coils and capacitors of the inverter circuit and the control circuit that constitute the control circuit portion 29 of the controller 4 are mounted on both faces of the circuit board 28.

The bus bars 18 that are connected to the coils 17, that are insulated and supported by the insulators 21, and that serve as the phase output terminals of the brushless motor 3 are passed through the circuit board 28, and are connected to the control circuit portion 29 mounted on the circuit board 28. On a side face of the motor housing 15, a connector shell (not shown) is formed integrally with the motor housing 15. Connector pins in the connector shell are connected to the control circuit portion 29 mounted on the circuit board 28.

In the present embodiment, the motor housing 15 and the cover 31 both of which are made of resin material are joined with each other through spin welding. An annular welding rib is formed on the back face of the cover 31 that covers an opening of the motor housing 15. The motor housing 15 and the cover 31 are welded together by melting the welding rib through heating while the cover 31 is rotated, and pressing the welding rib into a recess of the motor housing 15, which is a welding target and which is fixed. Further, the rotor 6 is inserted in the center portion of the motor housing 15, and then the pump housing 13 and the pump plate 14 are attached to each other and are fixed to the stator 5. In this way, the electric oil pump system 1 is assembled.

With the configuration as described above, the drive current controlled by the control circuit portion 29 is supplied to the coils 17 of the brushless motor 3. Thus, rotating magnetic fields are produced at the coils 17, and accordingly, torque is produced by the permanent magnets 8. As a result, the rotor 6 is rotated. As the inner rotor 11 is thus rotated, the outer rotor 10 is rotated in accordance with the rotation of the inner rotor 11 and the clearances between the internal teeth of the outer rotor 10 and the external teeth of the inner rotor 11 are repeatedly increased and decreased. In this way, the pumping action is carried out, that is, the oil is sucked in through the inlet and discharged through the outlet.

Next, the operation and the advantageous effects of the thus configured electric oil pump system 1 according to the present embodiment will be described.

In the above-described configuration, the split stator cores 9 of the stator 5 of the brushless motor 3 are fixed by the metal collar 22, the pump housing 13 of the oil pump 23 is engaged with the collar 22 that extends in the axial direction, and the pump housing 13 and the metal nuts 16, which are embedded (molded) in the insulators 21 in the motor housing 15, are fastened to each other with the six bolts 19 that are passed through the pump housing 13 from the pump plate 14 and passed through the stator cores 9. At this time, the six nuts 16 are in contact with the stator cores 9, and are arranged at equal intervals along the circumferential direction around the rotational axis.

Thus, the pump housing 13 and the stator 5 (stator cores 9), which are located between the pump plate 14 and the nuts 16 embedded in the insulators 21, are fixedly fastened under metallic contact. Therefore, even when the motor housing 15 is made of resin, it is possible to prevent the motor housing 15 from being creep-deformed due to age deterioration under the fastening force of the bolts 19. Further, neither warpage of the stator cores 9 nor loosening of the bolts 19 occurs. Moreover, the multiple nuts 16 are arranged in the insulators 21 at equal intervals. Therefore, it is possible to prevent the fastening force of the bolts 19 from being unevenly applied to the insulators 21.

As a result, warpage of the stator 5 and loosening of the bolts 19 are prevented. Therefore, it is possible to prevent rotation fluctuation of the rotary drive shaft 7 of the brushless motor 3, and reduce contact noise between the external teeth of the inner rotor 11 and the internal teeth of the outer rotor 10 of the oil pump 2 and pulsation of the discharge pressure. As a result, it is possible to suppress operating noise of the electric oil pump system 1 and reduction in pump output. Further, because the fastening force is evenly applied to the fastened portions of the pump housing 13 and stator 5, it is possible to prevent abnormal noise of the oil pump 2 due to backlash. Further, because axial vibration and circumferential rotation of the stator cores 9, which may be caused due to the rotation of the rotor 6, are prevented, it is possible to reduce transmission loss of the drive power from the brushless motor 3 to the oil pump 2. Moreover, the centering of the stator 5 and the rotor 6 is performed accurately. Further, the brushless motor 3 is efficiently cooled because the outer peripheral face of the metal collar 22 is exposed to the ambient air.

As stated above, according to the present embodiment, it is possible to provide the electric oil pump system in which creep deformation of the resin mold portion of the stator is prevented, vibration of the motor and operating noise of the pump are suppressed, and the pump discharge pressure is stabilized.

One embodiment of the invention has been described above. However, the invention may be implemented in various other embodiments.

In the above-described embodiment, the bolts 19 are fastened to the six nuts 16 that are arranged in the insulators 21 at equal intervals in the circumferential direction around the rotational axis. However, the invention is not limited to this configuration. A smaller number of nuts (for example, three nuts that are arranged at equal angular intervals of 120 degrees) may be used as long as the fastening force of the bolts 19 is evenly regulated.

In the above-described embodiment, an internal gear pump is used as the oil pump 2. However, the invention is not limited to this configuration. For example, a vane pump or an external gear pump may be used as the oil pump 2. Further, even when an internal gear pump is used as the oil pump 2, the oil pump 2 is not limited to a trochoidal curve-type pump. Moreover, the internal teeth of the outer rotor 10 and the external teeth of the inner rotor 11 are not limited to teeth clearly having so-called tooth profile, and may be projected portions, protrusions or engaging portions.

In the above-described embodiment, the invention is applied to the electric oil pump system 1 that uses the brushless motor 3. However, the invention is not limited to this configuration. The invention may be applied to other systems that use a brushless motor similar to the brushless motor 3. Further, the invention may be applied to a brushed motor.

In the above-described embodiment, the rotor 6 of the brushless motor 3 is formed by arranging and fixing a plurality of the permanent magnets 8 on the outer peripheral face of the rotary drive shaft 7. However, a ring-shaped permanent magnet may be fixed to the rotary drive shaft.

What is claimed is:

1. An electric oil pump system, comprising:

an oil pump;

an electric motor that is arranged next to the oil pump in an axial direction, and that rotates the oil pump;

a housing of the oil pump and an electric motor housing being fastened together via a stator of the electric motor;

a cylindrical fixing member that is formed of a metal member and that fixes a stator core of the stator arranged radially inward of the cylindrical fixing member;

a hole extending through the stator core in the axial direction; and a fastener disposed in the hole, secured to the oil pump, and directly secured in contact with a side of the stator core opposite the oil pump;

the cylindrical fixing member being engaged with the housing of the oil pump and fixing the stator.

2. The system of claim 1, wherein the fastener comprises a bolt.

3. The system of claim 2, wherein the fastener further comprises:

a nut that engages the bolt and is directly secured in contact with the side of the stator core opposite the oil pump.

4. The system of claim 2, further comprising:

a pump plate disposed on a side of the housing of the oil pump opposite the stator;

a plate hole extending through the pump plate in the axial direction; and a head of the bolt that engages the pump plate;

the bolt being disposed in the plate hole and secured to the pump plate.

5. The system of claim 1, further comprising:

five additional fasteners and five additional holes.

6. The system of claim 1, further comprising:

two additional fasteners and two additional holes.

* * * * *